US007124619B1

(12) United States Patent
Lefavour et al.

(10) Patent No.: US 7,124,619 B1
(45) Date of Patent: Oct. 24, 2006

(54) HYDRAULIC TOOL WORKING HEAD

(75) Inventors: John D. Lefavour, Litchfield, NH (US); Thomas R. Faucher, Manchester, NH (US); Jennifer M. Peterson, Manchester, NH (US); Stephen Gonyaw, Concord, VT (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 11/213,417

(22) Filed: Aug. 26, 2005

(51) Int. Cl.
*B21D 37/10* (2006.01)

(52) U.S. Cl. ..... 72/456; 72/416

(58) Field of Classification Search ..... 72/546, 72/453.16, 416, 453.01, 407, 481.6, 470; 384/41; 81/129, 129.5
See application file for complete search history.

(56) References Cited

U.S. PATENT DOCUMENTS

| | | | | | |
|---|---|---|---|---|---|
| 566,827 | A * | 9/1896 | Wardwell | 72/416 |
| 4,055,980 | A | 11/1977 | Churla | 72/410 |
| 4,192,171 | A | 3/1980 | Hamilton | 72/416 |
| 4,292,833 | A * | 10/1981 | Lapp | 72/416 |
| 4,942,757 | A | 7/1990 | Pecora | 72/453.16 |
| 5,062,290 | A | 11/1991 | Hoover | 72/416 |
| 5,226,714 | A * | 7/1993 | Wright | 312/323 |
| 5,231,904 | A * | 8/1993 | Masbaum | 81/126 |
| 5,335,530 | A | 8/1994 | Homm | 72/402 |
| 6,220,074 | B1 | 4/2001 | Montminy et al. | 72/454 |
| 6,227,030 | B1 * | 5/2001 | Lefavour et al. | 72/416 |
| 6,230,542 | B1 | 5/2001 | Frenken | 72/456 |

* cited by examiner

*Primary Examiner*—Derris H. Banks
*Assistant Examiner*—Teresa M. Bonk
(74) *Attorney, Agent, or Firm*—Harrington & Smith, LLP

(57) ABSTRACT

A hydraulic tool working head including a frame, a ram and a connection between the ram and the frame. The frame has a first section with a hydraulic cylinder area, an opposite second section and a middle section connecting the first and second sections to each other. The ram is movably located in the hydraulic cylinder area and extends out of the first section of the frame towards the opposite second section of the frame. The connection between the ram and the middle section includes the middle section of the frame having two slots extending into opposite sides of the middle section and the ram having two cantilevered hook sections which generally face towards each other. The hook sections have ends slidably respectively located in the two slots of the middle section.

16 Claims, 6 Drawing Sheets

HYDRAULIC TOOL WORKING HEAD

BACKGROUND OF THE INVENTION

1. Field of the Invention

The invention relates to a working head of a hydraulic tool and, more particularly, to a sliding connection between a ram and a frame of the working head.

2. Brief Description of Prior Developments

U.S. Pat. No. 5,062,290 discloses a hydraulic tool having a movable ram. The C-shaped head of the tool has a dovetail key mounted in a vertical recess. The ram has a dovetail channel which receives the dovetail key to form a sliding connection between the ram and the head. U.S. Pat. No. 4,055,980 discloses a crimping tool having a frame with recesses and a lower die member, connected to a ram, which has two ribs that extend into the recesses. The ribs are provided to restrict rotation about the ram axis.

Hydraulic crimping tools having a C-head are known to exist in the art. The C-head of these tools is known to deflect due to the high force produced by the tool. Although the C-head can be designed to minimize this deflection, it still exists. When the head deflects, it is no longer aligned with the ram and the lower die holder. The Burndy division of FCI USA, Inc. sells the Y750 and the Y46 hydraulic compression tools which have a T track where the male profile is on the die holder and the female profile is on the head. This is referred to as an interior T track.

There is a desire to provide an alignment system to keep the die holder aligned during deflection of a C-head. Also, there does not exist an exterior T track where the male profile is on the head and the female profile is on the die holder. There is a desire to provide a frame head having an exterior T track design.

SUMMARY OF THE INVENTION

The invention comprises an alignment system for a hydraulic C-head crimping tool. The alignment system comprises an exterior T track design having a male profile on the frame of the head and a female profile on the die holder slidably mounted on the head frame.

In accordance with one aspect of the invention, a fluid tool working head is provided including a frame, a ram and a connection between the ram and the frame. The frame has a first section with a fluid cylinder area, an opposite second section and a middle section connecting the first and second sections to each other. The ram is movably located in the fluid cylinder area and extends out of the first section of the frame towards the opposite second section of the frame. The connection between the ram and the middle section includes the middle section of the frame having two slots extending into opposite sides of the middle section and the ram having two cantilevered hook sections which generally face towards each other. The hook sections have ends slidably respectively located in the two slots of the middle section.

In accordance with another aspect of the invention, a hydraulic tool working head is provided comprising a frame comprising a first section having a hydraulic cylinder area, an opposite second section and a middle section connecting the first and second sections to each other; a ram movably located in the hydraulic cylinder area and extending out of the first section of the frame towards the opposite second section of the frame; and a connection between the ram and the middle section of the frame. The connection comprises the middle section of the frame having a T shaped section along an interior facing side of the middle section which faces an area of movement of the ram between the first and second sections, and the ram comprising two cantilevered hook sections which generally face towards each other. The hook sections have ends slidably located behind a head section of the T shaped section. The interior facing side of the middle section comprises two ram hook mounting slots into an end of the T shaped section adapted to allow the ends of the hook sections to be located behind the head section of the T shaped section.

In accordance with one method of the invention, a method of manufacturing a hydraulic tool working head comprising providing a frame comprising a first section having a hydraulic cylinder area, an opposite second section and a middle section connecting the first and second sections to each other, wherein the middle section comprises a T shaped section along an interior facing side of the middle section which faces a ram movement area between the first and second sections; providing a ram comprising two cantilevered hook sections with ends which generally extend towards each other; inserting the ram into the hydraulic cylinder area; and locating the hook section of the ram along opposite respective exterior sides of the middle section with the ends of the hook sections extending into slots behind a head section of the T shaped section.

In accordance with another aspect of the invention, a hydraulic tool working head is provided comprising a frame comprising a first frame member forming at least a portion of a first section having a hydraulic cylinder area, and a one-piece second frame member connected to the first frame member, wherein the second frame member comprises an second section located opposite the first section and a middle section connecting the first and second sections to each other; a ram movably located in the hydraulic cylinder area and extending out of the first section of the frame towards the opposite second section of the frame, wherein the ram comprises a one-piece movable die holder member; and a movable connection between the one-piece movable die holder member and the middle section of the one-piece second frame member, wherein the movable connection comprises at least one portion of the one-piece movable die holder member wrapping around at least one exterior portion of the middle section of the one-piece second frame member to slidably attach the one-piece movable die holder member to the middle section of the one-piece second frame member.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
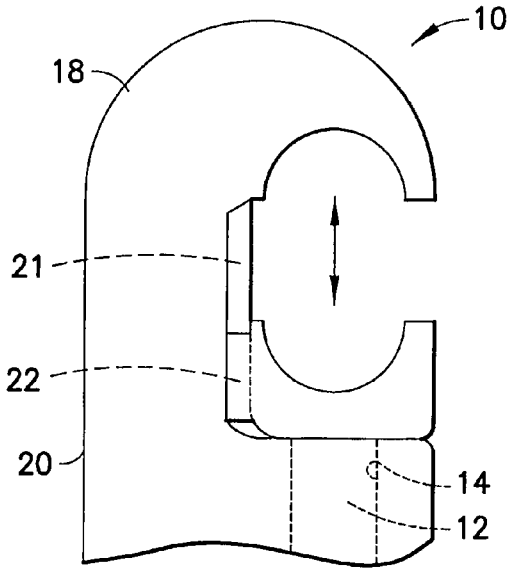
FIG. 1 PRIOR ART
FIG. 1 is a partial side view of a working head in a conventional hydraulic crimping tool.
Figure 2:
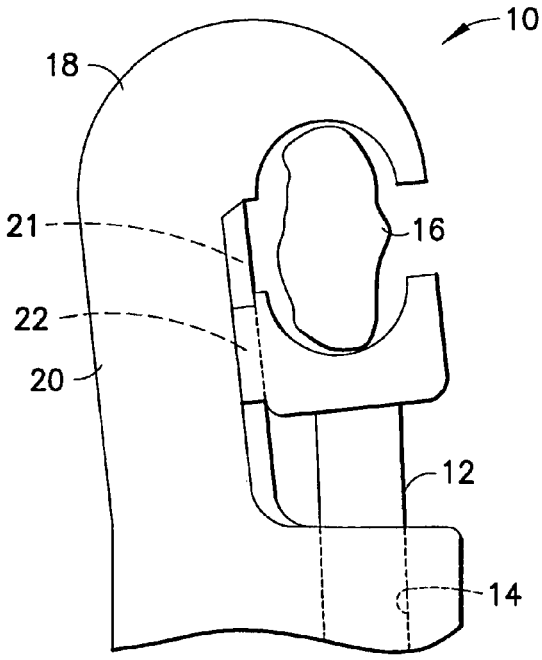
FIG. 2 PRIOR ART
FIG. 2 is a partial side view as in FIG. 1 showing deflection of the crimping head during crimping of an article.

In a hydraulic tool for compressing or crimping an electrical connector onto a conductor, such as the conventional tool 10 shown in FIG. 1, it is desirable to keep the piston ram 12 axially aligned to the center axis of the hydraulic cylinder 14. As seen with reference to FIG. 2, during compression of a work piece 16, the C shaped head 18 of the tool's working head frame 20 can deflect or bend. In the past, such as disclosed in U.S. Pat. No. 5,062,290, the hydraulic tool had a dovetail key 21 mounted to the frame 20 of the head. A dovetail channel 22 in the ram slid along the dovetail key 21. However, the high forces produced by the hydraulics could break the key 21 off of the frame 20.

Figure 3:
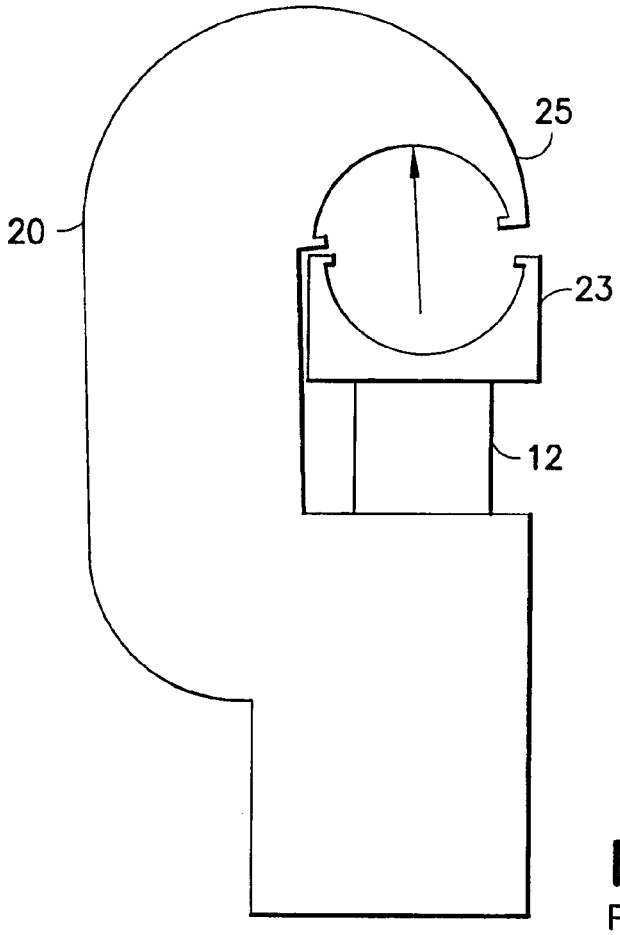
FIG.3 PRIOR ART
FIG. 3 is a side view of another conventional hydraulic crimping tool head.
Figure 4:
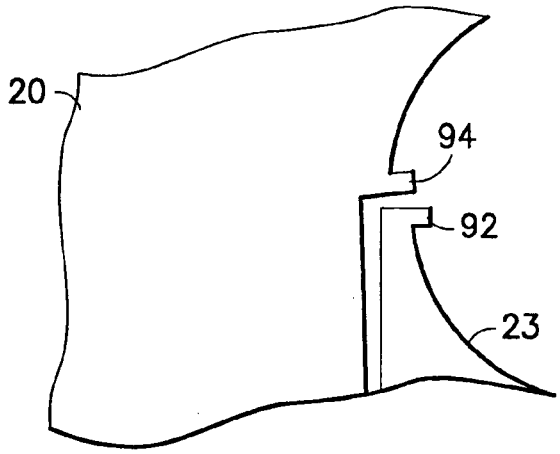
FIG.4 PRIOR ART
FIG. 4 is an enlarged view of the die holder tips of the head shown in FIG. 3 when the ram is moved to a fully extended position when the head is deflected due to crimping of an article.

Referring also to FIGS. 3 and 4, if a slidable interconnection between the ram 12 and the frame 20 of the head is not provided, the die holder portion 23 of the ram 12 does not follow the frame of the head as the frame is deflected backwards. Thus, a misalignment of the two die holder portions 23, 25 will occur. This could result in a defective or insufficient compression or crimp.

Figure 5:
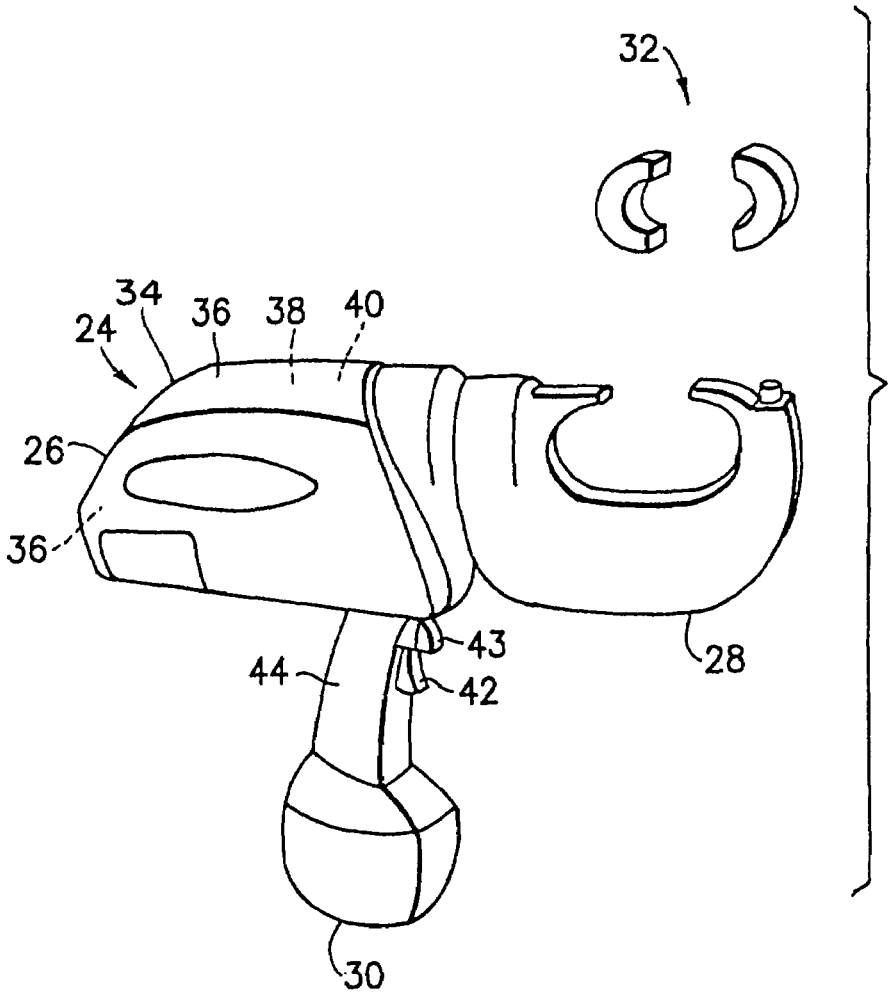
FIG. 5 is a perspective view of a hand-held, battery operated, hydraulic compression tool incorporating features of the invention.

Referring to FIG. 5, there is shown a perspective view of a tool 24 incorporating features of the invention. Although the invention will be described with reference to the exemplary embodiments shown in the drawings, it should be understood that the invention can be embodied in many alternate forms of embodiments. In addition, any suitable size, shape or type of elements or materials could be used.

The tool 24 is a hand-held battery operated hydraulic crimping tool. However, in alternate embodiments, features of the invention could be used in any suitable type of hydraulic tool or fluid tool such as a pneumatic tool for example, or any tool having a movable ram. The tool 24 generally comprises a main section 26, a working head 28, and a battery 30. In this embodiment the working head 28 is adapted to receive removable crimp dies 32. However, in alternate embodiments an suitable dies could be provided including cutting dies, or the working head might have non-removable crimping or cutting sections rather than removable dies.

The main section 26 generally comprises an exterior housing 34, an electric motor 36, a hydraulic pump 38, a fluid conduit system 40 including a fluid reservoir for conduiting fluid to and from the working head 28, and a control system including user actuated triggers 42, 43. In an alternate embodiment, the main section 26 could be adapted to be connected to a remote hydraulic fluid supply by hydraulic hoses. The housing 34 comprises a handle 44. The triggers 42, 43 are mounted on the handle. The battery 30 is removably mounted to the bottom of the handle 44. The battery comprises a rechargeable battery. In an alternate embodiment the battery might not be removable or might not be rechargeable.

Figure 6:
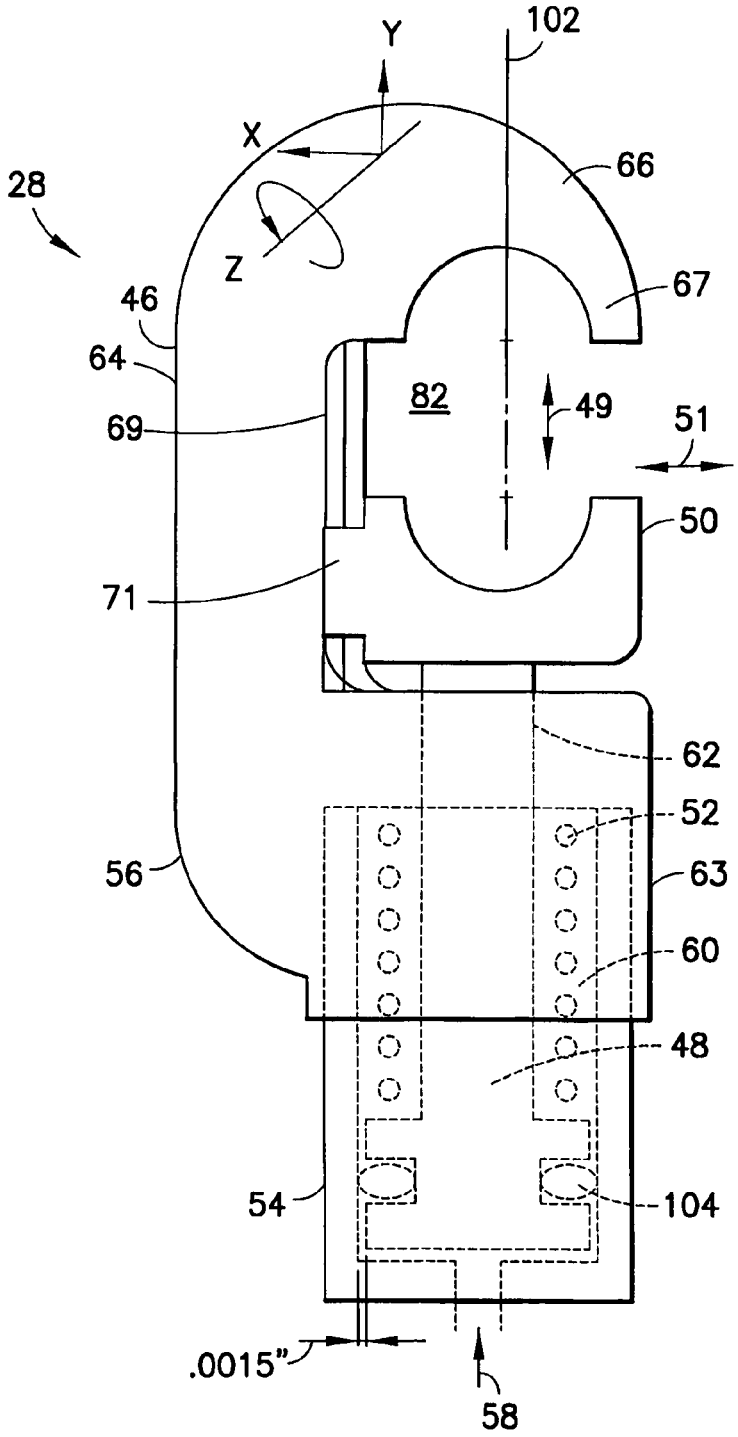
FIG. 6 is a side view of the working head of the tool shown in FIG. 3.

Referring also to FIG. 6, the working head 28 generally comprises a frame 46, a ram 48, a die holder section 50 at a top end of the ram 48, and a spring 52. The frame 46 comprises a first frame member 54 fixedly connected to a frame of the fluid conduit system 40 and a second frame member 56. The first frame member 54 comprises an inlet/outlet aperture 58 and a ram receiving area 60. The second frame member 56 is fixedly connected to the first frame member to substantially enclose the ram receiving area 60 except at the aperture 58 and a ram hole 62 through the second frame member 56. The spring 52 is located in the ram receiving area 60. The ram 48 is movably connected to the frame in a first longitudinal direction 49, wherein the ram is adapted to be moved relative to the frame by hydraulic fluid. The spring 52 biases the ram 48 in a retracted position as shown. However, the bias of the spring can be overcome by hydraulic fluid entering the area 60 from the aperture 58.

The second frame member 56 comprises a general C shaped profile. However, in alternate embodiments other types of shapes could be provided. The second frame member 56 is preferably a one-piece metal member. The bottom end of the C shaped profile is mounted to the first frame member 54. The C shaped profile comprises a first section 63 which forms a portion of the hydraulic cylinder area, an opposite second section 66 which forms a top section, and a middle section which forms a side extension 64. The middle section connects the first and second sections 63, 66 to each other. The top section 66 forms an upper die holder section 67 located opposite the lower die holder section 50 of the ram 48. The ram 48 is adapted to move the lower die holder section 50 towards and away from the upper die holder section 67.

The ram and the lower die holder section 50 could be a one piece member. Alternatively, the ram and the second movable member could be two members which are movably connected to each other, such as described in U.S. patent application Ser. No. 11/213,093, filed Aug. 26, 2005 which is hereby incorporated by reference in its entirety.

Figure 7:
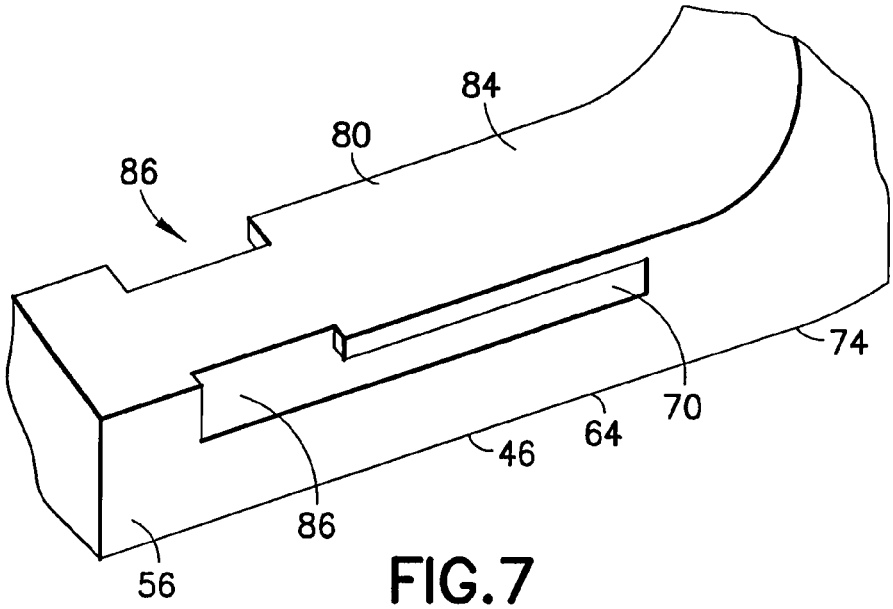
FIG. 7 is a partial perspective view of the middle section of the frame of the head shown in FIG. 6.
Figure 8:
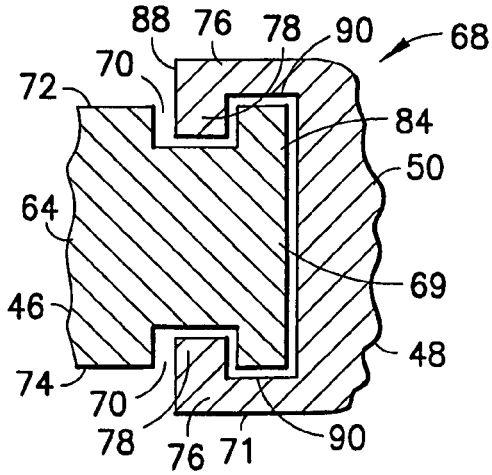
FIG. 8 is a cross sectional view of the connection of the lower die holder and the middle section of the frame of the head shown in FIG. 6.

Referring also to FIGS. 7 and 8, a slidable connection 68 is provided between the side extension or middle section 64 of the frame 46 and the die holder section 50 of the ram 48. The connection 68 comprises the middle section 64 of the frame having two slots 70 extending into opposite sides 72, 74 of the middle section, and the ram 48 comprising two cantilevered hook sections 76 which generally face towards each other. The hook sections 76 have ends 78 which are slidably, respectively located in the two slots 70 of the middle section 64. The cross sectional shape of the connection section of the middle section 64 forms a T shaped section 69 along an interior facing side 80 of the middle section which faces an area of movement 82 (see FIG. 6) of the ram between the first and second sections 63, 66 (see FIG. 6).

The two cantilevered hook sections 76 form an inverted or reverse T shaped section 71. The hook sections 76 extend from opposite sides of the interior facing side 88 of the die receiving section 50. The two cantilevered hook sections 76 have their ends 78 slidably located behind a head section 84 of the T shaped section. The interior facing side 80 of the middle section comprises two ram hook mounting slots or drop down slots 86 into an end of the T shaped section. The slots 86 form entrance slots through the interior facing side of the middle section adapted to allow passage of the ends 78 of the hook sections to be located behind the head section of the T shaped section. Arms 90 of the hook sections 76 are located along the opposite lateral sides of the head section 84.

With this embodiment the T track can be machined directly into the one-piece frame member 56. This is a more robust design than attaching a separate key member or dovetail insert into the frame as in the prior art. Although the T Track can resist rotation and side-to-side movement about the axis of the ram. It is primarily provided to ensure that the lower die holder section 50 and upper die holder section 67 are always aligned; even when the frame member 56 deflects due to forces from compression of an article between the two die holder sections. The top section 66 will deflect away from the center axis 102 (see FIG. 6) during compression of an article between the dies in the die holder sections 50, 67. The invention ensures that the lower die holder section 50 will follow the deflection path, thus moving substantially parallel to the deflection axis.

The invention comprises an alignment system for a hydraulic C-head crimping tool. Alignment of the lower and upper die holders is extremely important for proper connector installation and to insure that the head is being loaded correctly. Correct loading is when the load is distributed over the U-shaped die holder profile. Incorrect loading occurs when the tool is run without a connector and without butting dies. Also, incorrect loading can occur when crimping connectors that require full ram travel and use a non-butting dies. In these cases, the die holder lips 92, 94 (see FIG. 4) can be subjected to considerable loads and, if the upper and lower die holder becomes misaligned, die or lip failure is likely to result.

A T track system will guide the die holder and ram to follow the head while the head deflects and will keep the die holder profiles 50, 67 aligned. The T track system can be a track made of either a male or female T profile. The T track can be extruded the length of the head and the reverse profile can be extruded the length of the lower die holder. The T track profile on both the head and the lower die holder must be sufficiently large enough to withstand the pullout load created when the head deflects. There should also be enough surface area to minimize galling. In order to assemble a one-piece die holder onto a one-piece head frame, there can be a drop down slot on the head frame.

Exterior T tracks as shown in FIGS. 7 and 8 have some advantages over interior T tracks. They are easier to keep clean, easier to machine and give dimensional freedom since the track is located on an exterior surface. With the invention, the T track can be machined directly into the frame of the head. This is a more robust design than using a dovetail insert. The T track can be located between the neck or flange, for mounting to the rest of the tool, and the upper die holder which forms the stationary jaw. The T track of the invention can ensure that the die holder follows the head as the C-head is deflected backwards. The T track prevents rotation and side-to-side movement of the die holder, but more importantly keeps alignment between the two die profiles by forcing the movable die holder to move/tilt with the head during deflection of the head. The invention allows the loaded surfaces of the T track system to be farther away from the ram axis of the tool than a conventional dovetail insert design and is, therefore, a more stable design.

Figure 9:
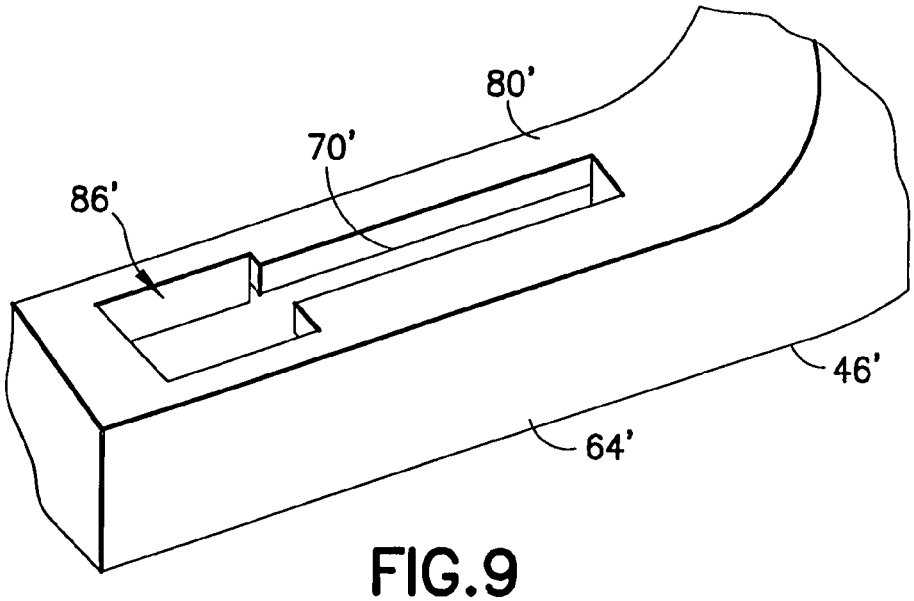
FIG.9 PRIOR ART
FIG. 9 is a partial perspective view of a middle section of a frame of a conventional tool head.
Figure 10:
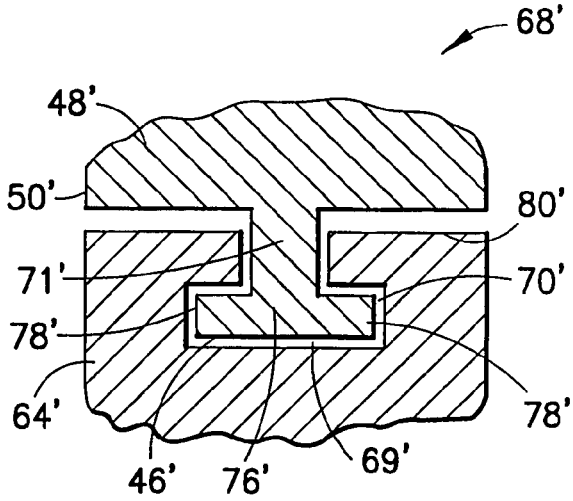
FIG.10 PRIOR ART
FIG. 10 is a cross sectional view of a conventional connection of the lower die holder and the middle section of the frame of the head shown in FIG. 9.

Referring now to FIGS. 9 and 10 details of a conventional connection is shown. In this conventional design, rather than an exterior track configuration as in FIGS. 7–8, an interior track configuration is provided. The slidable connection 68' is provided between the side extension or middle section 64' of the frame 46' and the die holder section 50' of the ram 48'. The connection 68' comprises the middle section 64' of the frame having one slot 70' extending into the middle of the interior facing side 80' of the middle section, and the ram 48' comprising one cantilevered hook section 76'. The hook section 76 has two outward extending ends 78' which are slidably, respectively located in opposite sides of the slot 70' of the middle section 64'. The cross sectional shape of the connection section of the middle section 64 forms a reverse or inverted T shaped section 69' along the interior facing side 80' of the middle section which faces the area of movement of the ram between the first and second sections of the second frame member.

The cantilevered hook section 76' forms a T shaped section 71'. The hook section 76' extends from the interior facing side of the die receiving section. The interior facing side 80' of the middle section comprises a ram hook mounting slot or drop down slot 86' into an end of the T shaped section 69'. The slot 86' forms an entrance slot through the interior facing side of the middle section adapted to allow passage of the hook section to be located in the slot of the frame member. With this design, similar to the exterior T track design described above, the T track designs could be formed in one-piece members (the C shaped frame member of the head and the lower die holder), thereby providing a more robust design than use of a dovetail insert. However, the exterior T track design described above would be easier to manufacture and easier to clean.

In one type of alternate embodiment, frame 46 might not comprise slots for hooks on the movable die holder. For example, the movable die holder could be comprised of multiple parts where the hooks are attached after the die holder is located on the head. The hooks could lock the die holder in place around the outward facing sides of the side extension 64. This type of embodiment would not need slots formed in the side extension 64. It is also possible that the die holder rides on rails or metal dowels that insert through the top or second section of the head. It is also possible that instead of having slots that cut into the sides of the side extension 64, the side extension 64 could comprise wings or projections that protrude from the sides of the side extension. The hooks on the movable die holder could rap around the wings. The die holder could be mounted to the side extension by rotating into place at a top end of the wings. In another embodiment either the head or movable die holder could be made of a flexible material that bends and allows the hooks or slots to open, to allow interconnecting of the two objects during assembly.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. A fluid tool working head comprising:

a frame comprising a first section having a fluid cylinder area, an opposite second section and a middle section connecting the first and second sections to each other, wherein the frame comprises a one-piece metal member;

a ram movably located in the fluid cylinder area and extending out of the first section of the frame towards the opposite second section of the frame; and a connection between the ram and the middle section of the frame, wherein the connection comprises the middle section of the frame having two slots extending into opposite sides of the one-piece metal member at the middle section and the ram comprising two cantilevered hook sections which generally face towards each other, and wherein the hook sections have ends slidably respectively located in the two slots of the middle section.

2. A fluid tool working head as in claim 1 wherein the frame comprises a general C shaped profile.

3. A fluid tool working head as in claim 1 wherein the middle section comprises entrance slots through an interior facing side of the middle section, wherein the entrance slots extend into the slots of the connection.

4. A fluid tool working head as in claim 1 wherein the middle section comprises a T shaped section along an interior facing side of the middle section which faces an area of movement of the ram between the first and second sections, wherein the slots are formed behind a head section of the T shaped section.

5. A fluid tool working head as in claim 1 wherein the ram comprises a die receiving section having a first die receiving area for removably receiving a first compression die, and wherein the second section comprises a second die receiving area for removably receiving a second compression die.

6. A fluid tool working head as in claim 5 wherein the two cantilevered hook sections extend from opposite sides of an interior facing side of the die receiving section.

7. A fluid compression tool comprising;

a main section comprising a pump and a fluid reservoir; and a fluid tool working head as in claim 1 connected to the main section.

8. A fluid tool working head as in claim 1 wherein the fluid tool working head comprises a hydraulic tool working head with the fluid cylinder area comprising a hydraulic fluid cylinder area.

9. A hydraulic tool working head comprising:

a frame comprising a first section having a hydraulic cylinder area, an opposite second section and a middle section connecting the first and second sections to each other, wherein the frame comprises a one-piece metal member;

a ram movably located in the hydraulic cylinder area and extending out of the first section of the frame towards the opposite second section of the frame; and a connection between the ram and the middle section of the frame, wherein the connection comprises the one-piece metal member at the middle section of the frame having a T shaped section along an interior facing side of the middle section which faces an area of movement of the ram between the first and second sections, and the ram comprising two cantilevered hook sections which generally face towards each other, wherein the hook sections have ends slidably located behind a head section of the T shaped section, and wherein the interior facing side of the middle section comprises two ram hook mounting slots into an end of the T shaped section adapted to allow the ends of the hook sections to be located behind the head section of the T shaped section.

10. A hydraulic tool working head as in claim 9 wherein the frame comprises a general C shaped profile.

11. A hydraulic tool working head as in claim 9 wherein the middle section comprises slots behind the head section adapted to allow the ends of the hook section to slide therealong.

12. A hydraulic tool working head as in claim 9 wherein the ram comprises a die receiving section having a first die receiving area for removably receiving a first compression die, and wherein the second section comprises a second die receiving area for removably receiving a second compression die.

13. A hydraulic tool working head as in claim 12 wherein the two cantilevered hook sections extend from opposite sides of an interior facing side of the die receiving section.

14. A hydraulic compression tool comprising:

a main section comprising a pump and a hydraulic fluid reservoir; and a hydraulic tool working head as in claim 9 connected to the main section.

15. A method of manufacturing a hydraulic tool working head comprising:

providing a frame comprising a first section having a hydraulic cylinder area, an opposite second section and a middle section connecting the first and second sections to each other, wherein the middle section comprises a T shaped section along an interior facing side of the middle section which faces a ram movement area between the first and second sections;

providing a ram comprising two cantilevered hook sections with ends which generally extend towards each other;

inserting the ram into the hydraulic cylinder area; and locating the hook section of the ram along opposite respective exterior sides of the middle section with the ends of the hook sections extending into slots behind a head section of the T shaped section.

16. A hydraulic tool working head comprising:

a frame comprising a first frame member forming at least a portion of a first section having a hydraulic cylinder area, and a one-piece second frame member connected to the first frame member, wherein the second frame member comprises a second section located opposite the first section and a middle section connecting the first and second sections to each other;

a ram movably located in the hydraulic cylinder area and extending out of the first section of the frame towards the opposite second section of the frame, wherein the ram comprises a one-piece movable die holder member; and a movable connection between the one-piece movable die holder member and the middle section of the one-piece second frame member, wherein the movable connection comprises at least one portion of the one-piece movable die holder member wrapping around at least one exterior portion of the middle section of the one-piece second frame member to slidably attach the one-piece movable die holder member to the middle section of the one-piece second frame member.

* * * * *